United States Patent [19]

Taylor

[11] Patent Number: 4,589,146

[45] Date of Patent: May 20, 1986

[54] GLOVE HAVING SECURING MEANS FOR IMPROVED GRIPPING

[76] Inventor: Clarence R. Taylor, 28 Woodside Dr., Penfield, N.Y. 14526

[21] Appl. No.: 668,010

[22] Filed: Nov. 5, 1984

[51] Int. Cl.[4] ..... A41D 19/00

[52] U.S. Cl. ..... 2/161 A

[58] Field of Search ..... 2/16, 17, 20, 161 R, 2/161 A, 160, 159

[56] References Cited

U.S. PATENT DOCUMENTS

| | | | |
|---|---|---|---|
| 730,051 | 6/1903 | Scott | 2/161 |
| 1,243,622 | 10/1917 | Nielsen | 2/161 R |
| 1,346,683 | 7/1920 | Reynolds | 2/161 R |
| 1,911,500 | 5/1933 | Gowdy et al. | 2/163 |
| 2,524,979 | 10/1950 | Kimbrell | 2/161 R |
| 2,895,139 | 7/1959 | Compton | 2/161 R |
| 3,649,967 | 3/1972 | Millman | 2/161 A |
| 4,107,840 | 8/1978 | Kupperman et al. | 2/161 R |

FOREIGN PATENT DOCUMENTS

| | | | |
|---|---|---|---|
| 1011502 | 7/1977 | Canada | 2/163 |
| 649632 | 1/1951 | United Kingdom | 2/16 |

*Primary Examiner*—Louis K. Rimrodt
*Assistant Examiner*—Joseph S. Machuga

[57] ABSTRACT

A glove is disclosed having a flexible fabric portion for covering the palm side of a hand. The fabric portion is provided with gripping members comprising one or more projections extending laterally outwardly from the fabric portion. The projections enable an object to be more securely gripped when the glove is placed on a hand and an object gripped thereby.

8 Claims, 11 Drawing Figures

GLOVE HAVING SECURING MEANS FOR IMPROVED GRIPPING

BACKGROUND OF THE INVENTION

1. Field of the Invention

This invention relates generally to gloves, and more specifically to an improved glove having securing means for improving the gripping ability of the glove.

2. Description of the Prior Art

It is known in the art to provide gloves of special fabric material, such as rubber, for example, or of perforated fabric material to improve the gripping ability of the glove. It is also known to provide an object, such as a golf club, with a rubber coated handle. The rubber handle is provided with an irregular surface, such as a notched or grooved surface, to improve the frictional securing force between the glove and handle to achieve improved gripping.

SUMMARY OF THE INVENTION

In accordance with a preferred embodiment of the invention, an improved glove is disclosed having the portion thereof covering the palm side of a hand formed of a flexible fabric material. The fabric material has at least one securing member comprising a projection extending laterally outwardly from the fabric.

In another embodiment of the invention, the fabric material is any suitable material such as, for example, leather, cotton, plastic, or a netting formed from such material.

In a more specific embodiment of the invention, the securing member comprises a tack-like member formed of metal or plastic. The tack-like member has a flat head attached to the fabric, and a projection extending laterally outwardly from the head.

In still another embodiment of the invention, the fabric material has an inner surface and an outer surface, and the flat head of the securing member is attached to the inner surface of the fabric. The projection extends laterally outwardly from the head through the fabric.

In still another embodiment of the invention, the flat head is attached to the fabric by bent tabs, thread or adhesive. A flexible liner is secured to the fabric over the flat head, and the projection has a broad base and a slightly rounded tip portion.

In a still more specific embodiment of the invention, the projections are shaped to extend into complementary openings in the object to be gripped.

A primary advantage of the improved glove of this invention is to provide a more secure grip when a gloved hand grips an object, such as a golf club, tennis racket, bat, or the like.

Another advantage of the improved glove of this invention, when worn and used to grip an object, is to roughen up the gripped surface of the object, thereby increasing the gripping friction between the gripped surface and a gloved hand gripping the surface.

Another advantage of the improved glove of this invention is that it can be manufactured from low cost fabric materials, and still provide a grip that is superior to the grip achieved by prior known gloves made from expensive materials, such as leather.

Still another advantage of the glove of this invention is to instill the user with increased confidence that the grip on the object will not slip.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Referring now to FIGS. 1–4 of the drawings, a preferred embodiment of an improved glove 10 of this invention is disclosed. The glove has a palm covering fabric portion 12 and thumb and individual finger covering fabric sections 14. However, it should be understood that the invention is not limited to gloves having individual finger covering sections, but also applies to unfingered gloves where the outer surfaces of the palm and fingers are all covered by a single fabric portion, as is well known in the art. The glove can be constructed of any suitable flexible fabric comprising materials such as soft leather, cotton, plastic, netting or the like.

Figure 1:
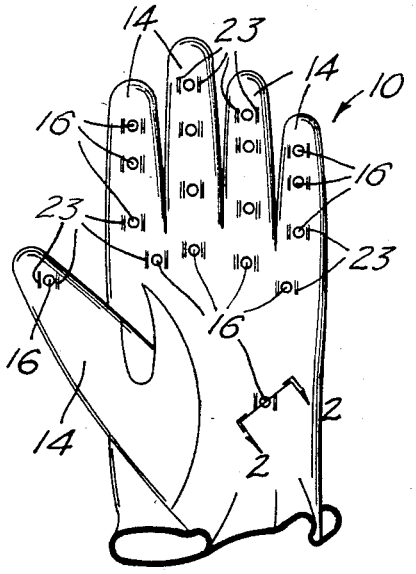
FIG. 1 is a top plan elevation view of a preferred embodiment of the glove of this invention.
Figure 2:
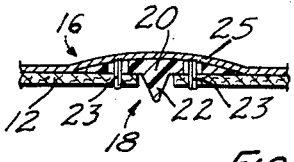
FIG. 2 is an enlarged segmental view in section taken substantially along line 2—2 of FIG. 1.
Figure 3:
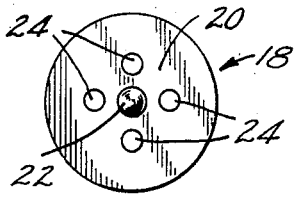
FIG. 3 is a bottom elevational view of the securing member of FIGS. 1 and 2.
Figure 4:
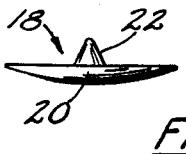
FIG. 4 is a side elevational view of the securing member of FIG. 3.

The glove is provided with gripping means 16 on the palm, thumb and finger covering portions thereof to enable the glove user to more securely grip any suitable member. This is particularly important in conditions where moisture or rain makes the gripping surface slippery. The gripping means, as best seen in FIGS. 2–4, comprises a tack-like member 18, preferably made of hard, durable plastic such as polycarbonate, for example, or metal, such as brass, steel or stainless steel. Tack-like member 18 has a large substantially flat circular head 20 and a central, laterally extending projection 22. The head 20 can be of any other suitable shape, such as square or rectangular, for example. The projection preferably has a broad base with an included angle of around 50°, and a slightly rounded point having a radius of about 0.005 to 0.008 inches (5 to 8 mils).

The tack-like members 18 are located at predetermined specific areas on the glove and in a desired number to provide the desired gripping action on any suitable member gripped by the glove user. The member could be, for example, the handle of a golf club, tennis racket, hockey stick, baseball bat, bicycle, motorcycle, oars, or anything else that requires a firm, secure grip. Members 18 are preferably secured or fastened to the inside surface of the palm and thumb and finger covering sections 12, 14 respectively by adhesive, or by sewing, namely passing thread 23 through openings 24 in head 20 and through the fabric in a similar manner to sewing a button on a garment. In the fastened position, the projection 22 extends through the fabric a distance of about 0.035 inches (35 mils) so that it can dig into the surface of a member being gripped.

Head 20 may be covered by a liner 25 made of any suitable flexible material which is placed over the head and secured to the fabric by any suitable means, such as thread or adhesive.

Figure 5:
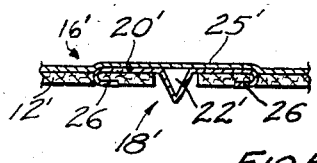
FIG. 5 is a segmental section view similar to FIG. 2 of another embodiment of the securing member.
Figure 6:
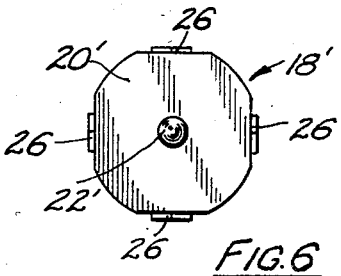
FIG. 6 is a bottom elevational view of the securing member of FIG. 5 before it is attached to the fabric material.
Figure 7:
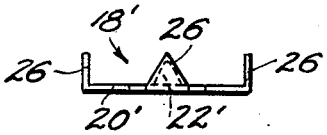
FIG. 7 is a side elevational view of the securing member of FIG. 6.

With reference to FIGS. 5–7, another embodiment of the invention is disclosed in which parts similar to parts shown in FIGS. 1–4 are denoted by the same numerals primed. In this embodiment, the tack-like member 18' is formed of a metal and has a plurality of peripheral, spaced apart, laterally extending pointed tabs 26. The member 18' is fastened to the fabric by pressing the tabs through the fabric and bending them over, as seen in FIG. 5. In this embodiment, the openings 24 are unneeded and are omitted.

Figure 8:
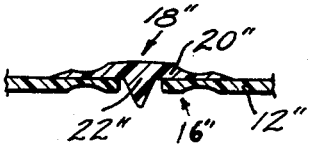
FIG. 8 is a segmental section view similar to FIGS. 2 and 5 of still another embodiment of the securing member.

With reference to the embodiment of the invention shown in FIG. 8, the fabric material and tack-like member 18" are formed of plastic, and are secured together by a heat seal formed by any suitable means, such as an ultrasonic horn, for example. Once again, openings 24 are unnecessary and hence are omitted.

Figure 9:
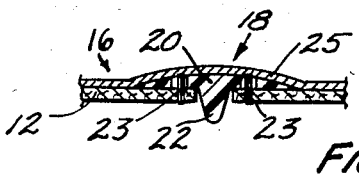
FIG. 9 is a segmental section view similar to FIGS. 2, 5 and 8 of still another embodiment of the securing member.
Figure 10:
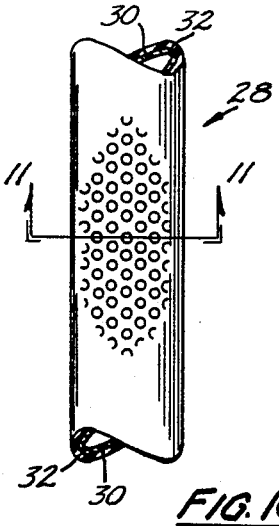
FIG. 10 is a segmental view of the handle of an object to be gripped by a gloved hand.
Figure 11:
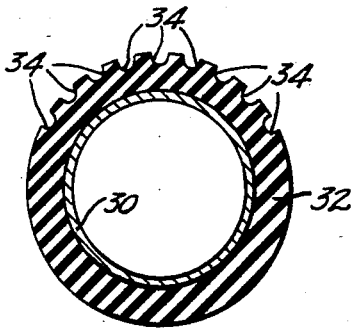
FIG. 11 is an enlarged section view taken substantially along line 11—11 of FIG. 10.

With reference to the embodiment of the invention shown in FIGS. 9–11, a member 28, which is to be gripped by a gloved hand, has a cylindrical core 30, and a gripping surface 32 bonded thereto having a plurality of indentations or holes 34, only a few of which are shown in FIGS. 10 and 11. The tack-like member 18 is provided with a projection 22 having a shape complementary to the indentations 34. Accordingly, when the gloved hand grips the member 28, the projections 22 firmly seat into the complementary indentations 34 to provide a more secure grip.

While preferred embodiments of the invention have been shown and described with particularity, it will be appreciated that various changes and modification may suggest themselves to one having ordinary skill in the art upon being apprised of the present invention. It is intended to encompass all such changes and modification as fall within the scope and spirit of the appended claims.

What is claimed is:

1. A glove for gripping the handle of a golf club or the like comprising:

a flexible fabric portion covering the palm side of a hand, said fabric portion having an inner surface facing the hand, an outer surface, and an opening extending through said fabric portion from said inner surface to said outer surface; and gripping means on said fabric portion comprising hard plastic or metal tack-like members, each tack-like member having a substantially flat head engageable with said inner surface and an integral projection extending from said flat head through said opening in said fabric portion and outwardly past said outer surface a distance of about 35 mils, said projection having a slightly rounded point having a radius of about 5 to 8 mils adapted to dig into the handle of the golf club.

2. A glove according to claim 1 wherein said fabric portion is a cloth fabric portion.

3. A glove according to claim 1 wherein said fabric portion is a soft leather fabric portion.

4. A glove according to claim 1 wherein said flat head has openings extending therethrough, and said head is fastened to said inner surface by a thread.

5. A glove according to claim 1 wherein each of said heads is secured to said inner surface by an adhesive.

6. A glove according to claim 1, and further comprising a flexible liner positioned over said flat head and fastened to said inner surface of said fabric portion.

7. A glove according to claim 1 wherein said fabric portion and said tack-like members, are fastened together by heat sealing.

8. A glove according to claim 1 wherein said tack-like members have peripheral, spaced apart, laterally extending pointed tabs adapted to pass through said fabric portion and to engage said outer surface when said tabs are bent to fasten said tack-like members to said fabric.

* * * * *